United States Patent [19]

Wyant

[11] Patent Number: 4,779,791

[45] Date of Patent: Oct. 25, 1988

[54] PORTFOLIO

[75] Inventor: Jon R. Wyant, Spring Valley, Ohio

[73] Assignee: The Mead Corporation, Dayton, Ohio

[21] Appl. No.: 150,952

[22] Filed: Feb. 1, 1988

[51] Int. Cl.[4] ..... B65D 37/00

[52] U.S. Cl. ..... 229/1.5 R; 229/72; 281/15 B

[58] Field of Search ..... 229/1.5 R, 68 R; 206/472, 474, 214, 205, 232; 281/15 B, 31, 45

[56] References Cited

U.S. PATENT DOCUMENTS

| | | | |
|---|---|---|---|
| 708,525 | 9/1902 | Buskirk | 206/215 |
| 3,870,223 | 3/1975 | Wyant | 229/1.5 R |
| 4,420,112 | 12/1983 | Cline | 281/15 B |
| 4,485,962 | 12/1984 | Farley | 229/1.5 R |

*Primary Examiner*—Willis Little

*Attorney, Agent, or Firm*—Biebel, French & Nauman

[57] ABSTRACT

A portfolio particularly adapted for use in the taking and retaining of hand writen notes comprises front and back cover boards adhered in spaced relation to the inside of a cover sheet of woven decorative fabric that forms a combined gusset and hinge by which the portfolio can be opened to lie flat. A liner sheet covering the inner surfaces of the cover boards is adhered thereto along its outer marginal portion, but it is not attached to the central area of the back cover board in order to form therewith a pocket to which access is provided by a slit in the liner sheet. An envelope designed to receive and retain sheets of writing paper is attached to the portfolio by insertion of its flap portion in the slit in the liner sheet, and the front wall of this envelope is in turn provided with a slit adjacent one end thereof which is proportioned to receive the paperboard back of a note or sketch pad, and thereby to mount such a pad on the envelope as a further component of the portfolio.

10 Claims, 2 Drawing Sheets

PORTFOLIO

BACKGROUND OF THE INVENTION

This invention relates to a portfolio or folder of simple construction and inexpensive materials which is especially adapted to facilitate the making and protected retention of notes handwritten by the user thereof.

More specifically, the invention has among its objectives the provision of such a portfolio which is particularly adapted to fabrication from paper board covered with a fabric that imparts both beauty and strength to the finished product, and also the provision of such a fabric-covered paperboard which incorporates both a pad of writing paper for use in the taking of handwritten notes and an envelope for retaining those notes within the portfolio.

SUMMARY OF THE INVENTION

A typical preferred embodiment of the invention can be succinctly described as book-like, in that it comprises front and back cover boards adhered in spaced relation to the inside of a cover sheet of woven decorative fabric that forms a combined gusset and hinge by which the portfolio can be opened to lie flat. A liner sheet covers the inner surfaces of the cover boards and is adhered thereto along its outer marginal portion, and it also extends across and reinforces the gusset and hinge portion of the cover sheet.

The liner sheet is not attached to the central area of the back cover board in order to form therewith a pocket to which access is provided by a slit in the liner sheet adjacent and parallel with the hinge portion of the portfolio. This pocket and slit are used to provide a connection between the portfolio and an envelope designed to receive and retain sheets of writing paper containing notes or other information inscribed thereon by the user of the portfolio.

More specifically, the portfolio of the invention comprises as one of its component elements, an envelope, preferably of the gusseted wallet-style type, which includes a top flap that is proportioned to be folded back and inserted through the slit in the liner sheet to provide a firm mounting of the envelope on the back cover of the portfolio. In addition, the front wall of this envelope is provided with a slit adjacent one end thereof which is proportioned to receive the paperboard back of a note or sketch pad, and thereby to mount such a pad on the envelope as a further component of the portfolio.

As already noted, the basic construction of the portfolio of the invention promotes the use of a decorative fabric as its cover sheet, to impart both strength and beauty to the product. In addition, the same objectives are contributed to by forming the envelope inside the portfolio of paperboard having laminated thereon a cover layer of plastic which not only contributes materially to the strength of the envelope, but also can have reproduced thereon a decorative pattern such particularly as the same pattern as that of the fabric cover layer.

Other objects, advantages, and features provided by the invention are noted in or will be apparent from the description of a preferred embodiment hereinafter.

DETAILED DESCRIPTION OF THE PREFERRED EMBODIMENT

Figure 1:
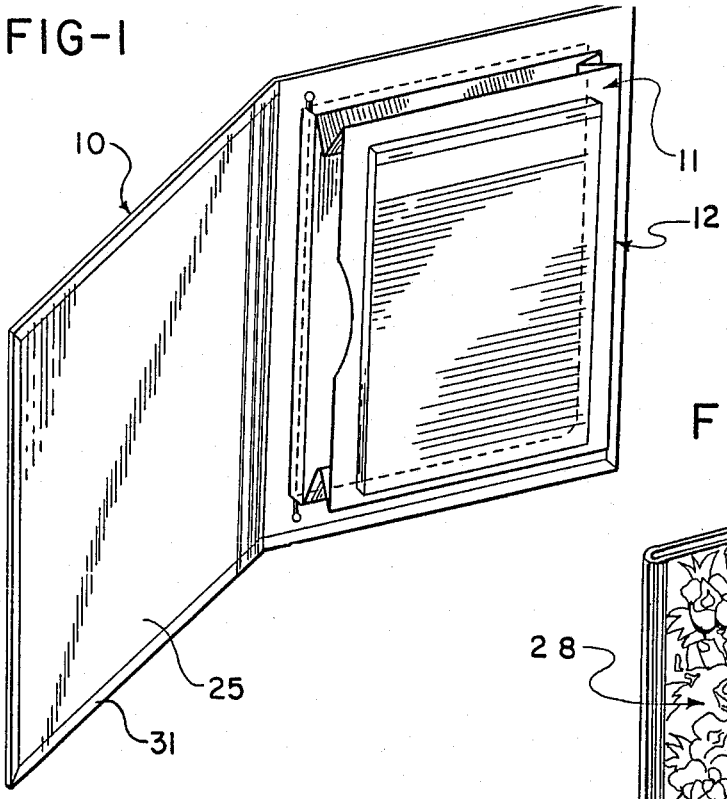
FIG. 1 is a perspective view showing a portfolio embodying the invention in partially opened condition.

The drawings illustrate a preferred embodiment of the invention which comprises three basic components, namely the portfolio cover 10, the envelope 11 mounted inside the cover 10, and the pad 12 of writing paper, which comprises a backing sheet 15 of paperboard having mounted thereon a plurality of sheets 16 of writing paper. As further described hereinafter, the envelope 11 is provided with a firm mounting inside the portfolio cover 10, and the pad 12 is in turn provided with a firm mounting on the envelope 11.

Figure 2:
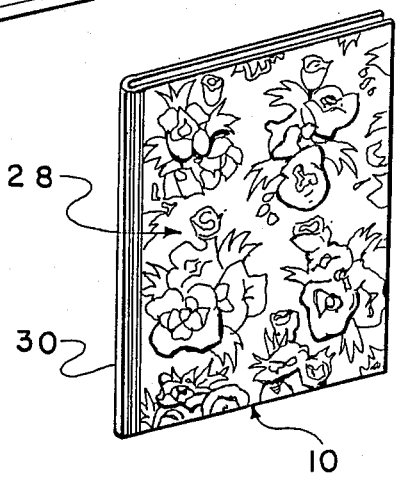
FIG. 2 is a perspective view of the front of the closed portfolio of FIG. 1.
Figure 3:
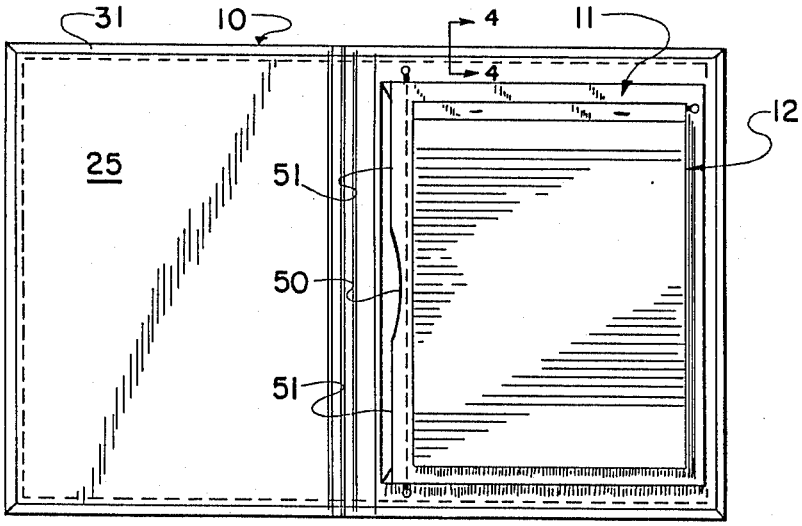
FIG. 3 is an elevational view showing the inside of the portfolio of FIG. 1 in fully opened condition.

The individual elements which are combined to form the portfolio cover 10 are the fabric cover sheet 20, the front and back cover boards 21 and 22, the fabric inner liner sheet 25, and the reinforcing sheet 26 of paperboard inside the back cover of the portfolio 10. In the fabrication of this portfolio, the cover boards 21 and 22 are adhered, by any suitable adhesive, to the inner surface of the fabric sheet 20 with their adjacent edges spaced to provide a combined hinge and gusset portion 30 of fabric sheet 20. As shown in FIG. 2, the outside of the fabric cover sheet 20 is preferably provided with a decorative design 28, which may be of any desired pattern.

Figure 4:
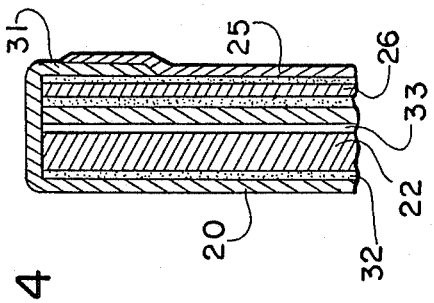
FIG. 4 is a fragmentary section on the line 4—4 of FIG. 3 and on a much enlarged scale.

In a typical example of the invention, the boards 21 and 22 may have dimensions of 10 and 13 inches, with a margin therebetween of 0.375 inch to establish the corresponding width for the gusset portion 30. The fabric sheet 20 should initially be sufficiently larger than the combined boards 21 and 22 to provide a marginal strip 31 approximately one-half inch wide overlying and adhered to the inner marginal surfaces of the boards 21–22 after this strip 31 has been wrapped around the edge of the adjacent board In FIG. 4, adhesive layers are shown at 32, but since the adhesive is in each case between layers of fabric and paperboard or between two layers of fabric, it will be absorbed into the fabric and will therefore not appear as a separate layer in the finished product.

The paperboard reinforcing sheet 26 is preferably somewhat thinner than the boards 21–22. For example, it may consist of 30-point board as compared with 60-point boards 21–22. The sheet 26 is preferably sufficiently smaller than the board 22 to lie just within the marginal portions 31 of the fabric cover sheet 20, and it is adhered to the inner surface of the cover sheet 25. However, sheet 26 is not otherwise attached to the cover board 22 and thus defines therewith a pocket 33 to which access is provided by a slit 35 extending through both of sheets 25 and 26 parallel with and adjacent the gusset portion 30.

Figure 5:
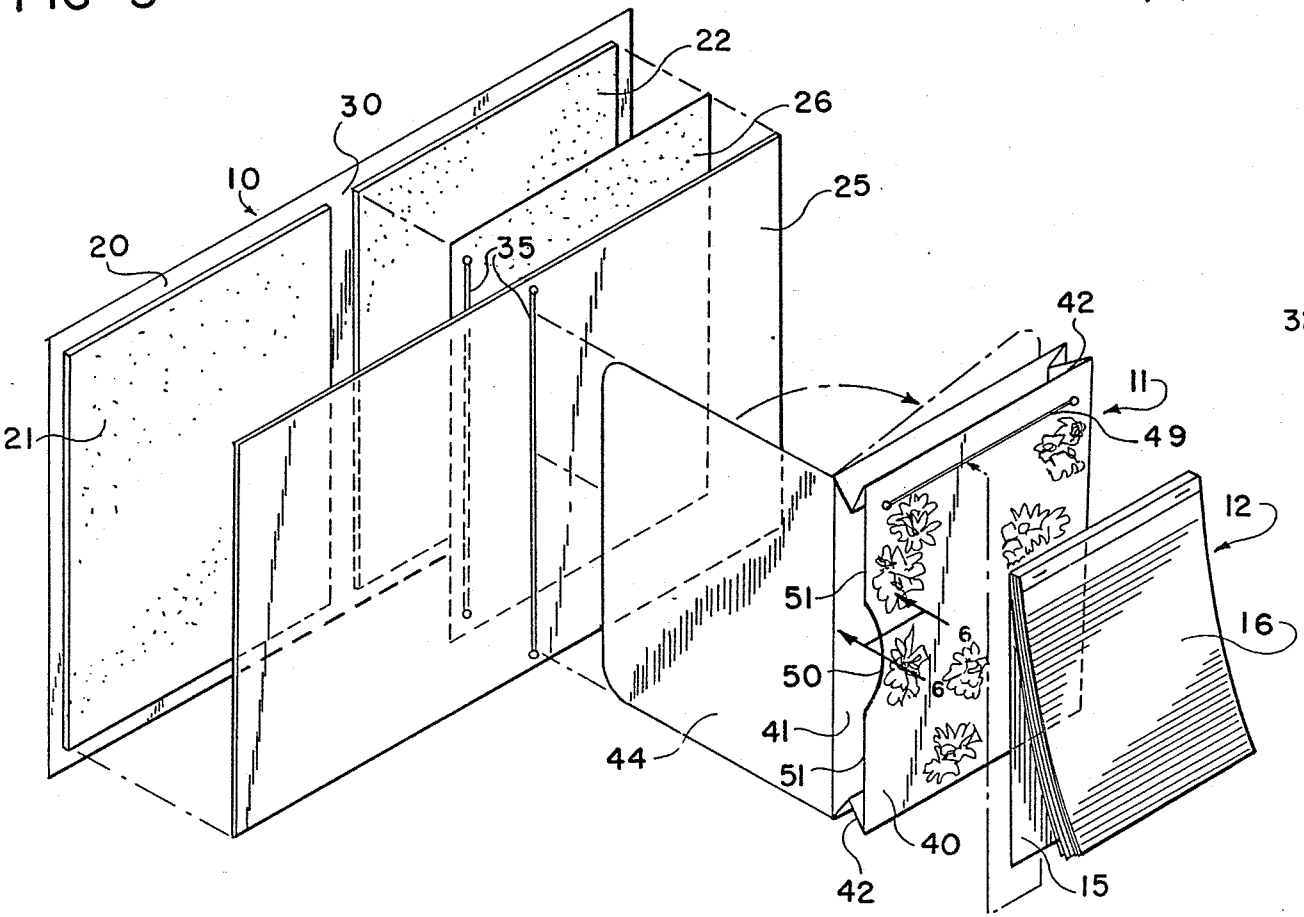
FIG. 5 is an exploded view of the components of the portfolio shown in FIGS. 1–4.

This combination of pocket 33 and slit 35 provides means for mounting the envelope 11 on the back cover board 22 of the portfolio. More specifically, the envelope 11 is formed from a front wall 40 and a back wall 41 which are connected together along their end and bottom edges by folded strips 42 forming a gusset, and in the preferred embodiment having the dimensions already noted, the gusset strips 42 are proportioned to provide for a total expanded thickness of envelope 11 of 2¼ inches. The back wall 40 has an integral flap 44 extending from its upper ege which forms a cover for the envelope when the latter is removed from the portfolio. Also, as indicated at 48 in FIG. 5, the outer surface of the plastic layer 46 may be printed with a decorative design, which is shown as the same as the design 28 on the fabric cover sheet 20 but of course may be different if desired.

In the combination of the invention, however, the flap 44 is folded back and inserted through the slit 35 into the pocket 33, thereby providing a firm mounting for the envelope 11 on the portfolio cover. In the preferred practice of the invention, all of the component parts of the envelope 11 are formed of a layer 45 of 12-point paperboard having a layer 46 of suitable plastic laminated thereto and forming the outer surface of each of the envelope walls.

In order to join the pad 12 of paper with the other components of the portfolio, the front wall 40 of the envelope 12 is provided with a slit 49 extending parallel with and adjacent the end of the envelope which is uppermost in the assembled portfolio. This slit 49 is of the appropriate length to receive the backing sheet 15 of pad 12 therethrough, thereby providing a firm connection between the envelope and the pad.

It is contemplated that in the use of the portfolio of the invention, notes will be taken, or sketches made, on successive sheets of paper 16, and each such used sheet can be torn from the pad and temporarily stored in the envelope 11. Obviously, this envelope can also be initially supplied with reference material, such particularly as in advance of a meeting at which the portfolio is to be used in conjunction with note taking.

Figure 6:
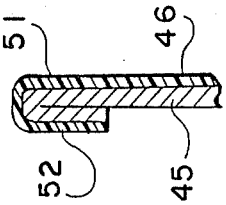
FIG. 6 is a fragmentary section on the line 6—6 of FIG. 5 on a much enlarged scale.

In order to facilitate use of the envelope 11, the exposed edge of its front wall 40 is provided with a notch 50 extending along its center portion. The remaining straight portions 51 of this edge are reinforced by folding marginal strips 52 of the board material along the edge to the inside of the wall and adhering them to the inner surface of the wall, as shown in FIG. 6.

An important feature of the invention is the provision for substantial storage capacity in the envelope 11 which is contributed by the gusset, and it should also be noted that for such occasions when this envelope is filled to capacity, the front cover board 21 is provided with a series of score lines 55 extending parallel with the hinge 30 to facilitate bending of board 21 into parallel relation with the back cover board 22 when the thickness of the contents of the portfolio exceeds the width of the hinge portion 30.

While the product herein described constitutes a preferred embodiment of the invention, it is to be understood that the invention is not limited to this precise product, and that changes may be made therein without departing from the scope of the invention which is defined in the appended claims.

What is claimed is:

1. A portfolio particularly adapted for use in the taking and retaining of handwritten notes, comprising:

(a) separate front and back covers of stiff board material, (b) a cover sheet of stretch and tear resistant material overlying and adhered to said cover boards with the adjacent edges of said boards spaced from each other to provide a combined hinge and gusset portion of said cover sheet between said cover boards, (c) an inner liner sheet of stretch and tear resistant material overlying the inner surface of said back cover board and adhered to the periphery of said cover board, (d) said lined sheet being non-attached to the major portion of the central surface of said back cover board to define therewith a pocket and having therein a slit extending parallel with and adjacent said hinge portion to provide access to said pocket, (e) an envelope including front and back walls of board material connected together along the bottom and sides thereof to define a pocket adapted to receive and retain sheets of note paper, (f) said envelope also including a flap hingedly connected to the top of said back wall thereof to form a cover therefor, (g) said flap being folded back and extended through said slit into said pocket between said liner sheet and said back cover board to attach said envelope to said back cover board, (h) said front wall of said envelope having therein a slit adjacent and parallel with one end thereof, (i) a pad of note paper including a supporting back of board material, and (j) said pad back being extended through said slit in said envelope wall into the interior of said envelope to mount said pad on said envelope.

2. A portfolio as defined in claim 1 wherein the marginal edges of said cover sheet are extended around and adhered to the outer marginal portions of said cover boards, and said liner sheet covers both of said cover boards and is adhered to said marginal portions of said cover sheet.

3. A portfolio as defined in claim 1 wherein said cover sheet is a decorative woven fabric, and said liner sheet is a woven fabric.

4. A portfolio as defined in claim 1 wherein said envelope walls are connected by folded strips of the same material which form a gusset connection between said walls.

5. A portfolio as defined in claim 3 wherein said envelope walls comprise paperboard having a plastic outer cover layer adhered thereto.

6. A portfolio as defined in claim 5 wherein along at least a portion of the exposed edge of said front envelope wall, said plastic covered paperboard is folded over to provide a double thickness edge portion.

7. A portfolio as defined in claim 3 wherein said plastic cover layer has thereon the same decorative design as said fabric cover sheet.

8. A portfolio as defined in claim 1 wherein a layer of paperboard is adhered to the inner surface of the portion of said liner sheet overlying said back cover board and is non-attached to said back cover board to define therewith said pocket, said slit in said liner sheet extending also through said paperboard layer.

9. A portfolio as defined in claim 1 wherein said front cover board is provided with at least one score line parallel with and spaced from the edge thereof adjacent said hinged portion of said cover sheet to facilitate bending of said board and corresponding increase of the effective width of said hinge portion.

10. A portfolio particularly adapted for use in the taking and retaining of handwritten notes, comprising:

(a) separate front and back covers of stiff paperboard material, (b) a cover sheet of woven fabric overlying and adhered to said cover boards with the adjacent edges of said boards spaced from each other to provide a combined hinge and gusset portion of said cover sheet between said cover boards, (c) the edges of said cover sheet being extended around and adhered to the outer edges of said cover boards, (d) an inner liner sheet of woven fabric overlying the inner surfaces of said cover boards and adhered to said edges of said cover sheet and to said front cover board, (e) a layer of paperboard adhered to the inner surface of the portion of said liner sheet overlying said back cover board, (f) said paperboard layer being non-attached to said back cover board to define therewith a pocket, (g) said liner sheet and said paperboard layer having therein a common slit extending parallel with and adjacent said hinge portion of said cover sheet to provide access to said pocket, (h) an envelope of board material including front and back walls connected together along the bottom and sides thereof to define a pocket adapted to receive and retain sheets of note paper, (i) said envelope also including a flap hingedly connected to the top of said back wall thereof to form a cover therefor, (j) said flap being folded back and extended through said slit into said pocket between said liner sheet and said back cover board to attach said envelope to said back cover board, (k) said envelope front wall having a slit therethrough adjacent and parallel with one end thereof, (l) a pad of note paper including a supporting back of board material, and (m) said pad back being extended through said slit in said envelope wall into the interior of said envelope to mount said pad on said envelope.

* * * * *